US005775775A

United States Patent [19]

Hoffman

[11] Patent Number: 5,775,775

[45] Date of Patent: Jul. 7, 1998

[54] RECLINING SEATING UNIT AND METHOD FOR CONSTRUCTING SAME

[75] Inventor: D. Stephen Hoffman, High Point, N.C.

[73] Assignee: Ultra-Mek, Inc., Denton, N.C.

[21] Appl. No.: 528,675

[22] Filed: Sep. 14, 1995

[51] Int. Cl.[6] ..... A47C 1/02

[52] U.S. Cl. ..... 297/316; 297/85; 297/322

[58] Field of Search ..... 297/316, 317, 297/322, 341, 342, 69, 83, 84, 85, 87

[56] References Cited

U.S. PATENT DOCUMENTS

| | | | |
|---|---|---|---|
| 2,163,505 | 6/1939 | Thornton-Norris | 297/322 X |
| 2,746,520 | 5/1956 | Ducrot | 297/322 |
| 3,337,267 | 8/1967 | Rogers, Jr. | 297/322 |
| 3,567,280 | 3/1971 | Bradshaw | 297/322 X |
| 3,941,417 | 3/1976 | Re | 297/322 X |
| 5,480,213 | 1/1996 | Sproule | 297/85 X |

FOREIGN PATENT DOCUMENTS

| | | | |
|---|---|---|---|
| 509505 | 1/1955 | Canada | 297/317 |
| 691437 | 4/1940 | Germany | 297/322 |

*Primary Examiner*—Laurie K. Cranmer
*Attorney, Agent, or Firm*—Myers Bigel Sibley & Sajovec, LLP

[57] ABSTRACT

A reclining press-back seating unit utilizes modified three-way reclining mechanisms. The three-way mechanism is modified to be free of a footrest, and is mounted within the press-back seating unit so that its links are positioned in the upright position in the same orientation to one another that they would be in the TV position of the three-way reclining unit. The seating unit can be used with virtually any three-way reclining mechanism, including those for wall-avoiding units and high-leg units, to create pressback versions of these units which are particularly suitable for use in multiple seat seating units.

23 Claims, 10 Drawing Sheets

RECLINING SEATING UNIT AND METHOD FOR CONSTRUCTING SAME

FIELD OF THE INVENTION

The present invention relates generally to seating units and relates more specifically to reclining seating units.

BACKGROUND OF THE INVENTION

Reclining chairs and other seating units have become quite popular in residential settings. Recliners typically include some type of mechanism that, when actuated, causes the seat and backrest of the recliner to pivot relative to the base in order to place an occupant of the seating unit in a reclined position. Recliners can be stand-alone units (such as the well-known recliner chair) , can comprise one or more sections of a modular unit, such as a pit-style sofa, or can be included in a multi-seat unit, such as a love seat or sofa.

Most recliners move between an upright and one or more reclined positions, although many recliners differ in the degree to which such movement occurs. Generally, chairs move between an "upright" position, in which the backrest is disposed in its most upright position and any extendable footrest is retracted beneath the seat, and a "fully reclined" position, in which the backrest has been reclined to its shallowest angle relative to the floor, and any footrest is extended in front of the seat. Many chairs also are configured to move to an intermediate "TV" position from the upright position, in which any footrest is projected forwardly from the chair, the backrest and seat essentially retain their relative angular relationship, and the backrest may pivot relative to the base so that the backrest is disposed at a slightly shallower angle relative to the floor.

Recliners can also be categorized by the relative movement of the base, the seat, the backrest, the arms, and any footrest in different positions. For example, a "one-way" recliner includes a seat and headrest which are rigidly fixed to one another. One-way recliners move between an upright and a fully reclined position. Thus, although the seat and backrest move relative to the base, they do not move relative to one another. A "two-way" recliner includes a seat and backrest which are rigidly fixed to each other, but the chair is movable between an upright position, a TV position, and a fully reclined position. The footrest of a two-way recliner is extended in the TV and fully reclined positions. A "three-way" recliner has a backrest that can pivot relative to the seat. The three-way recliner moves into an upright position, a TV position, and a fully reclined position relative to a fixed base. Typically the angle between the backrest and the seat increases between the upright position and at least the fully reclined position. As is the case for two-way recliners, the footrest is extended in both the TV and fully reclined positions.

In addition to these general categories, specific performance concerns have led to the development of specialized recliners. One of these is the "wall-avoiding" recliner, which was developed to enable a recliner to be placed so that the rear surface of its backrest is adjacent a wall. As it reclines to the TV position, the seat of a wall-avoiding chair moves forwardly relative to the base; thus, when the recliner takes a fully reclined position, the backrest is able to pivot rearwardly relative to the seat and still avoid striking the adjacent wall. The footrest remains extended in both the TV and fully reclined positions.

Another specialized recliner type is the so-called "high-leg" recliner. This recliner was developed in response to consumer demand for more attractive styles, as many recliners produced prior to the high-leg recliner were quite bulky and thus unattractive. They were required to be bulky to hide the reclining mechanisms, which were positioned beneath the armrests and extended vertically essentially from the floor to the seat. In contrast, the high-leg recliner includes reclining mechanisms that collapse into a package with a relatively small vertical dimension and thus remain hidden when the recliner is in the upright position. This enables the mechanism to be used with chair styles in which the base of the chair is positioned several inches above the floor. For example, a typical high-leg chair has a 9 inch front leg and an 8 inch rear leg, and supports a 4 to 5 inch thick cushion at a height of about 19 inches. Thus the reclining mechanism for such a chair must fit into a 5 to 6 inch tall space. As with the wall-avoiding recliner, the footrest is extended in the TV position and remains extended in the fully reclined position.

Another well-known type of recliner is the so-called "press-back" recliner. Press-back recliners, which are actuated by a seated occupant pressing against the backrest with his back, typically move from an upright to a fully reclined position. This movement is generally controlled by a relatively simple mechanism or even by a single pivot between the backrest and seat reinforced by springs or gas cylinders to resist rearward movement. In addition, press-back recliners typically lack a footrest.

Although each of these recliner types are well-known, they fail to satisfy certain situations in which a recliner is to be combined with other furniture as part of a set or ensemble. For example, it may be desirable for a sofa that includes reclining sections to reside adjacent a wall. However, inclusion of a wall-avoiding section employing known mechanisms such as that described above also include an extendable footrest; otherwise, the balance of the seat, which relies in part on the weight provided by the occupant's extended legs, would be adversely affected. The inclusion of an extendable footrest would limit the manner in which a coffee table or other occasional table could be used in combination with the sofa, as the coffee table could not be placed directly in front of and adjacent the sofa because the footrest would strike the coffee table. The use of a press-back type mechanism of the type described above would prevent the sofa from being positioned so that its backrest is adjacent a wall. Also, a typical wall proximity unit cannot be used with a separate ottoman or footstool. The prior art is silent regarding how this problem can be addressed.

A similar difficulty is encountered with high-leg mechanisms to be used in sofas. Because the high-leg mechanism relies on the weight of the occupant's extended legs for balance in the fully reclined position, such a mechanism would be unsuitable for use in a sofa that is to have a coffee table directly in front of it. Also, high-leg recliners typically have a footrest that is visible in the front of the chair in the upright position. Many consumers object to the appearance of the footrest if the furniture ensemble includes a stationary high-leg chair with a different front appearance.

In view of the foregoing, it is an object of the present invention to provide a mechanism for a seating unit that would enable the seating unit having a reclining seating unit to be placed with its backrest adjacent a wall and to be used with an adjacent coffee table.

It is also an object of the present invention to provide a mechanism that enables a high-leg seating unit to be used in combination with an adjacent coffee table.

It is a further object of the present invention to provide a method of manufacturing such chairs without engendering significant costs for retooling.

SUMMARY OF THE INVENTION

These and other objects are satisfied by the present invention, which provides a method for designing a press-back seating unit. The press-back seating unit is movable between upright and reclined positions and comprises a base, a seat positioned generally above the base, and a backrest positioned above the base and rearward of the seat. The reclining seating unit is free of an extendable footrest. In the upright position, the backrest is generally upright and the seat is generally horizontal, and the backrest and seat define a first angle, and in the reclined position, the seat is generally horizontal, and the backrest and seat define a second angle greater than the first angle.

The first step of the method comprises identifying a first mechanism configured for use in a three-way recliner chair, in which the recliner chair has a base, a seat, a backrest, and a footrest attached to and movable with the first mechanism, and in which the recliner chair is movable between upright, TV, and reclined positions. In the upright position, the seat is generally horizontal and positioned above the base, the backrest is generally upright and positioned generally rearwardly from the seat and defines with the seat a third angle, and the footrest is folded beneath the forward portion of the seat. In the TV position, the footrest is extended forwardly of the seat and the third angle defined by the backrest and the seat is essentially unchanged from the upright position. In the reclined position, the footrest is positioned forwardly of the seat, and the backrest and seat define a fourth angle greater than the third angle. The first mechanism comprises a plurality of pivotally interconnected links and includes a footrest linkage attached to the footrest for extending the footrest as the chair moves from the upright to the TV position, and further includes a drive linkage connected to the footrest linkage for pivoting the backrest relative to the seat as the chair moves from the TV to the reclined position. The second step of the method of the present invention comprises designing a second mechanism having a substantial number of the same links that comprise the drive linkage of the first mechanism and that is free of a footrest linkage. The third step of the method comprises designing a reclining seating unit that includes the second mechanism to control the movement of the backrest and seat relative to each other and to the base. The reclining seating unit is designed so that the second mechanism is mounted to the base, seat, and backrest such that, when the recliner chair is in the upright position, each of the plurality of pivotally interconnected links comprising the second mechanism is positioned in substantially the same relationship to each of the other links of the second mechanism as its corresponding link of the first mechanism when the first mechanism is in the TV position, and when the reclining seating unit is in the reclined position, each of the plurality of links comprising the second mechanism is positioned in substantially the same relationship to each of the other links of the second mechanism as its corresponding link of the first mechanism when the first mechanism is in the reclined position.

An additional aspect of the present invention is a seating unit comprising: a base configured to rest upon an underlying surface; a seat positioned generally above the base having front and rear end portions; a backrest positioned generally above the base and generally rearward of said seat having an upper end and a lower end; and a mechanism interconnecting the base, the seat, and the backrest. The mechanism comprises a plurality of pivotally interconnected links and is free of links forming a footrest linkage. The mechanism is mounted to the base, seat and backrest and configured so that the seat and backrest move between an upright position and a reclined position. In the upright position, the seat slopes slightly downwardly from its forward end portion to its rearward end portion at a first predetermined pitch angle relative to the underlying surface, and the backrest is disposed to be generally upright, with its upper end portion positioned slightly rearwardly of its lower end portion. In the reclined position, the seat is positioned forwardly of its position in the upright position relative to the base, and the backrest is pivoted relative to the seat to be disposed less upright than in the upright position, with its upper end portion being positioned lower than in the upright position and its lower end being positioned forward of its position in the upright position. The backrest upper end is positioned between about 0 and 6 inches rearward from its position in the upright position. As a result, the seating unit can be placed in its upright position with the backrest upper end portion adjacent a wall and can move to its reclined position without the backrest upper end portion striking the adjacent wall.

As another aspect, the present invention provides a high-leg seating unit comprising: a base configured to rest upon an underlying surface; a seat positioned generally above the base; a backrest positioned generally above the base and generally rearward of the seat having an upper end portion and a lower end portion; and a mechanism interconnecting the base, the seat, and the backrest. The mechanism comprises a plurality of links and is free of links forming a footrest linkage. The mechanism is mounted to the base and configured so that the seat and backrest move between an upright position and a reclined position. In the upright position, the seat slopes slightly downwardly from its forward end portion to its rearward end portion at a first predetermined pitch angle relative to the underlying surface, and the backrest is disposed to be generally upright, with its upper end portion positioned slightly rearwardly of its lower end portion. In the reclined position, the seat is positioned forwardly of its position in the upright position relative to the base, and the backrest is pivoted relative to the seat to be disposed less upright than in the upright position, with its upper end portion being positioned lower than in the upright position. In the upright position, the mechanism is configured so that the height between the seat and the lowest point of the mechanism is less than about 6 inches.

DETAILED DESCRIPTION OF THE PREFERRED EMBODIMENTS

The present invention will now be described more particularly hereinafter with reference to the accompanying drawings, in which present embodiments of the invention are shown. The invention can, however, be embodied in many different forms and should not be limited to the embodiments set forth herein; rather, these embodiments are provided so that this disclosure will be thorough and complete and will fully convey the scope of the invention to those skilled in the art.

This invention is directed to seating units that have a stationary base, a seat portion, and a backrest. As used herein, the terms "forward", "forwardly", and "front" and derivatives thereof refer to the direction defined by a vector extending from the backrest toward the seat parallel to the underlying surface. Conversely, the terms "rearward", "rearwardly", and derivatives thereof refer to the direction directly opposite the forward direction; the rearward direction is defined by a vector that extends from the seat toward the backrest parallel to the underlying surface. The terms "lateral," "laterally", and derivatives thereof refer to the direction parallel with the floor, perpendicular to the forward and rearward directions, and extending away from a plane bisecting the seating units between their armrests. The terms "medial," "inward," "inboard," and derivatives thereof refer to the direction that is the converse of the lateral direction, i.e., the direction parallel with the floor, perpendicular to the forward direction, and extending from the periphery of the seating units toward the aforementioned bisecting plane.

In addition, mechanisms for moving portions of the seating units illustrated herein between upright and one or more reclined positions are illustrated as a series of pivotally interconnected links. Those skilled in this art will appreciate that the pivots illustrated herein can take a variety of configurations, such as pivot pins, rivets, bolt and nut combinations, and the like, any of which would be suitable for use with the present invention.

Figure 1:
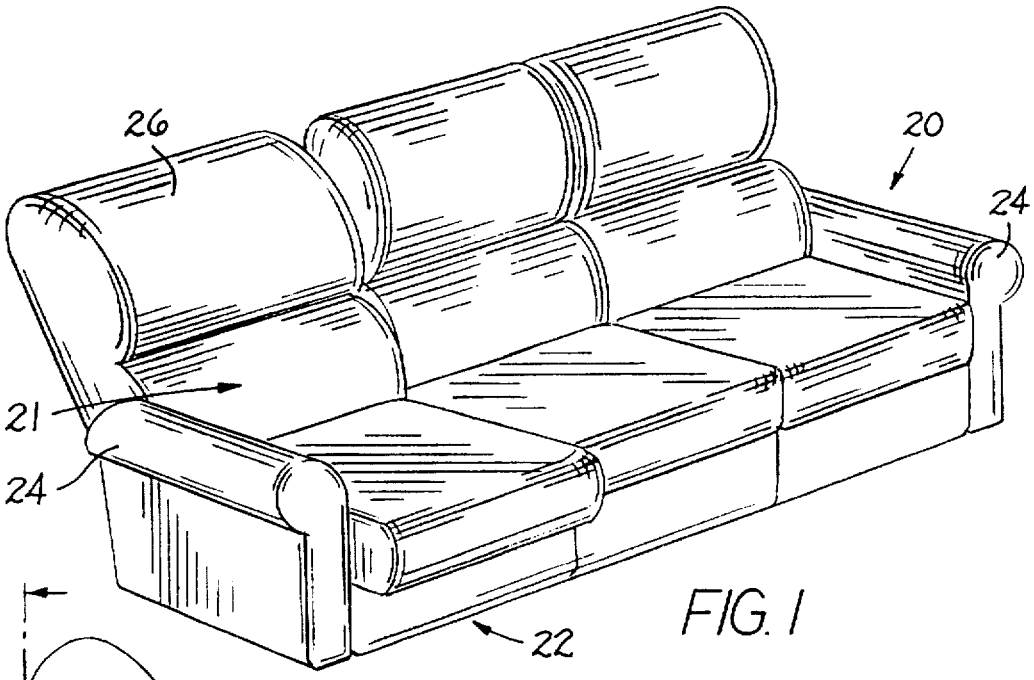
FIG. 1 is a perspective view of a press-back reclining portion of a sofa of the present invention.
Figure 2:
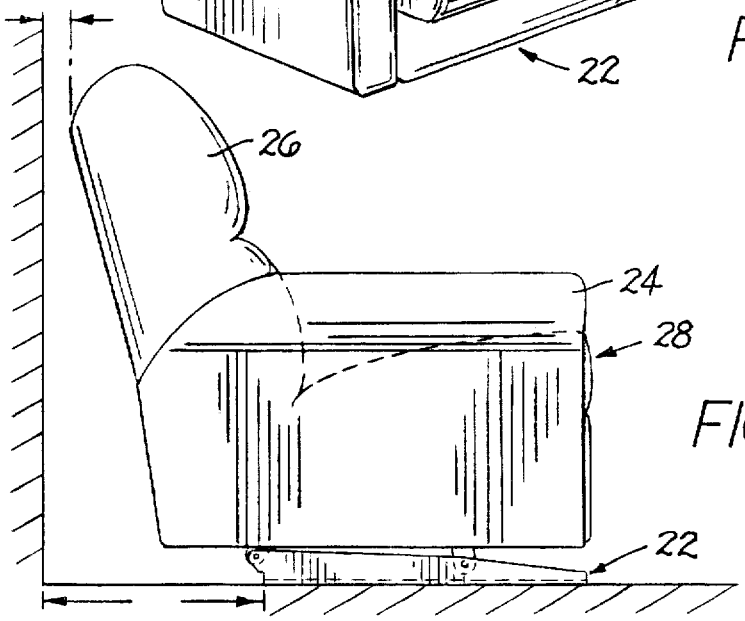
FIG. 2 is a side view of the press-back reclining seating unit of FIG. 1, with the reclining portion shown in its upright position.

Referring now to the Figures, FIGS. 1 and 2 illustrate a sofa, designated broadly at 20, that includes a wall-proximity press-back reclining portion 21, designated broadly at 20. The reclining portion 21 comprises a base 22 configured to rest upon underlying surface, a pair of armrests 24, a backrest 26, and a seat 28. In the upright position shown in FIG. 1, the backrest 26 is generally upright, and the seat 28 is generally horizontally disposed above the base 22.

Although the sofa 20 is illustrated and described herein, those skilled in this art will appreciate that the present invention is suitable for use with a variety of seating units, such as love seats, chairs, couches, pit-style sofas, and motion modular units, for which wall-proximity reclining performance is desirable.

Figure 7:
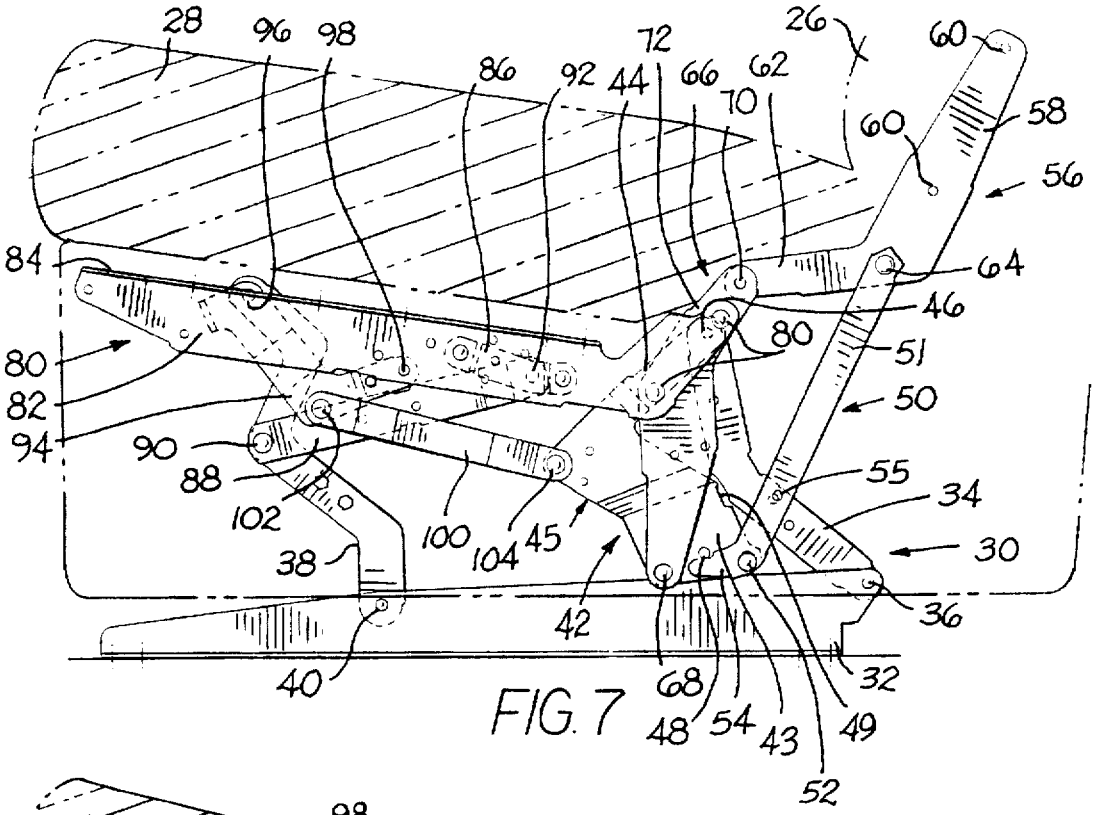
FIG. 7 is an enlarged cross-sectional side view of the reclining portion of the sofa of FIG. 1 in its upright position.
Figure 8:
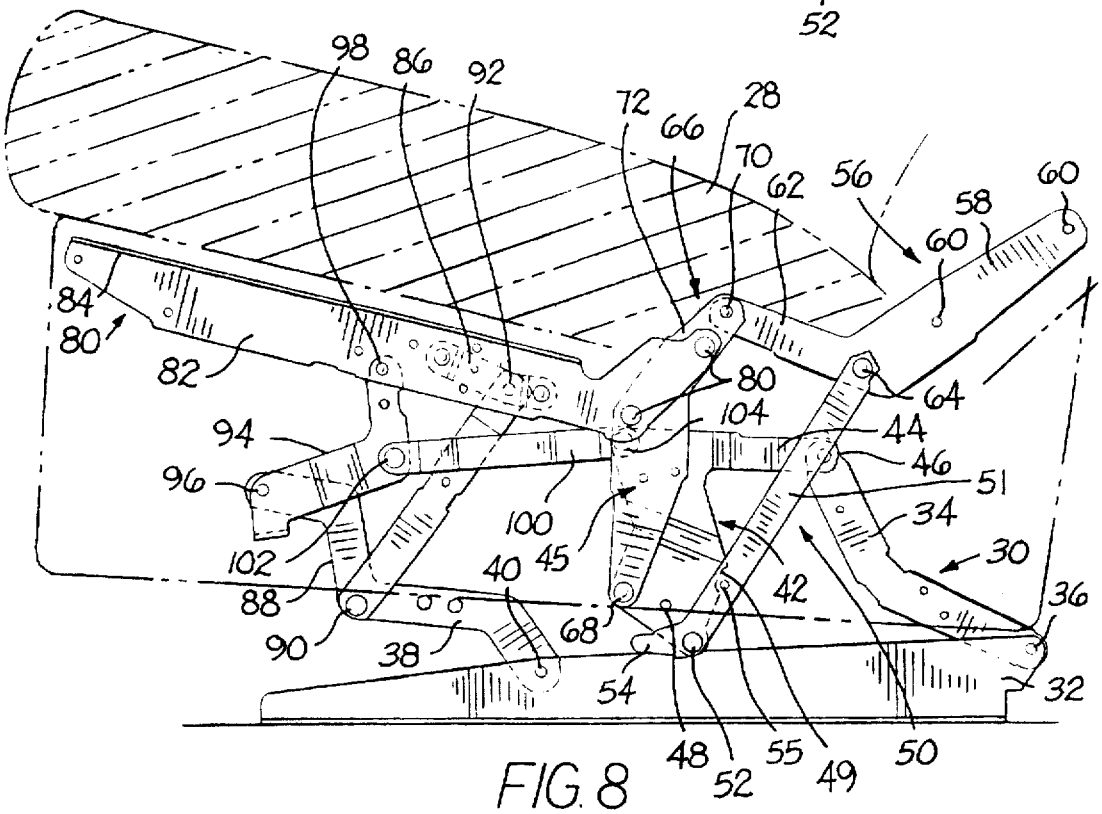
FIG. 8 is a cross-sectional side view of the reclining portion of the sofa of FIG. 1 in its reclined position.

The base 22, backrest 26, and seat 28 are interconnected by a pair of mechanisms 30 (best seen in FIGS. 7 and 8). Although only one mechanism 30 is illustrated herein, those skilled in this art will appreciate that a mirror image mechanism is included on the opposite side of the reclining chair 20. The mechanism 30 is illustrated in its retracted position in FIG. 7, which corresponds to the upright position of the recliner portion 21 illustrated in FIG. 2, and is further illustrated in its extended position in FIG. 8, which corresponds to the reclined position of the recliner portion 21 illustrated in FIG. 3.

As is shown in FIG. 7, the base 22 comprises a base rail 32 to which the mechanism attaches through a rear swing link 34 and a front swing link 38. The rear swing link 34 is a wide V-shaped structure that pivotally interconnects to the rearmost portion of the base rail 32 at a pivot 36. The front swing link 38 is a quadripartite shallow M-shaped structure that is pivotally interconnected at its lower end to the base rail 32 at a pivot 40. The pivot 40 is positioned forwardly from and, notably, slightly lower than the pivot 36 on the base rail 32.

The mechanism 30 also includes a transition panel 42, which comprises a main body 43, an extension leg 44 extending from one end thereof, and a wedge-shaped leading portion 45 at its opposite end. The transition panel 42 is pivotally interconnected with the rear swing link 34 at a pivot 46 located at the free end of the extension leg 44. The main body 43 also includes a stop pin 48 extending laterally therefrom and a knot 49 on its rearward edge.

A sock-shaped driving link 50 is interconnected with the transition panel 42 at a pivot 52 located on the leading portion 45. From the pivot 52, the driving link 50 extends upwardly and rearwardly in a main branch 51 and also extends generally forwardly in a finger 54. A stop pin 55 extends inwardly from the main branch 51 and is positioned to contact the notch 49 of the transition panel 42 upon appropriate rotation.

At its upper end, the main branch 51 of the driving link 50 is interconnected to the vertex of a V-shaped backrest post 56 at a pivot 64. The backrest post 56 includes a main panel 58, which has apertures 60 for interconnecting the main panel 58 to the backrest 26. The backrest post 56 further includes a lower leg 62 which originates at the vertex and extends forwardly therefrom.

A rear drawing link 66 pivotally interconnects the transitional panel 42 with the backrest post 56, with the rear drawing link 66 being connected at its lower end to the lower end of the transition panel 42 at a pivot 68 and being connected at its upper end to the forward end of the backrest post lower leg 62 at a pivot 70. The upper end portion 72 of the rear drawing link is fixed to the rear end portion of a seat rail 80 via a pair of bolts 74. The seat rail 80 includes a vertical flange 82 and a horizontal flange 84 that extends laterally therefrom. The horizontal flange 84 includes apertures (not shown) which attaches to the seat 28. The seat rail 80 also includes a connection bracket 86 on its inboard surface.

A front drawing link 88 interconnects the front swing link 38 with the seat rail 80. More specifically, the lower end of the front drawing link 88 is pivotally interconnected with a central portion of the front swing link 38 at a pivot 90, and the upper end of the front drawing link 88 is pivotally interconnected at a pivot 92 to the connection bracket 86.

The upper and forward end of the front swing link 38 is connected at a pivot 96 to a substantially L-shaped elevating link 94. The opposite end of the elevating link 94 is pivotally connected to the vertical flange 82 of the seat rail 80 at a pivot 98, which is positioned forwardly from the connection bracket 86.

The actions of the front and rear swing links 38, 34 are synchronized via a connecting link 100. The connecting link 100 is connected at its forward end to the vertex of the elevating link 94 at a pivot 102, and is connected to the forward portion of the transition panel main body 43 at a pivot 104.

Figure 3:
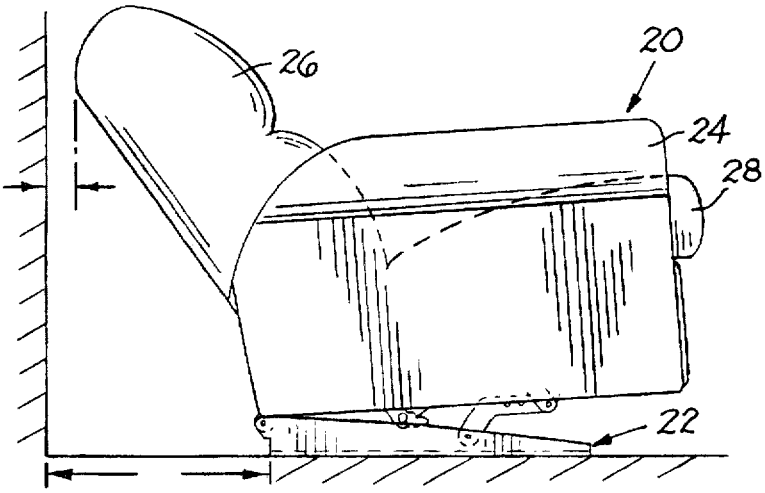
FIG. 3 is a side view of the reclining seating unit of FIG. 1, with the reclining portion shown in its reclined position.

In operation, the recliner portion 21 moves between the upright position illustrated in FIGS. 2 and 7 and the reclined position illustrated in FIGS. 3 and 8. In the upright position, the seat rail 80 is inclined so that its rearward end is lower than its forward end, thereby defining a pitch angle with the underlying surface. Preferably, this pitch angle is between about 3 and 12 degrees, and more preferably is between about 5 and 10 degrees. The backrest post 56 is disposed so that the lower leg 62 thereof is generally horizontal. In the position the backrest 26 is generally upright, with its upper end portion being slightly rearwardly of its lower end portion. Each of the rear and front swing links 34, 38 extends forwardly and upwardly from its respective pivotal interconnection with the base rail 32. The driving link 50 is disposed so that the main branch 51 thereof is generally parallel with the backrest post main panel 58 and so that the upper edge of the finger 54 contacts the stop pin 48. The transition panel 42 is disposed so that the extension arm 44 extends upwardly and rearwardly from the main body 43. The connecting link 100 is inclined downwardly from its front to its rearward end. The front drawing link 88 is gently inclined with its rearward end above its forward end. The elevating link 94 is disposed so that its forward end is positioned above both its rearward end and the pivot 102 between the central portion of the elevating link 94 and the connecting link 100.

Figure 4:
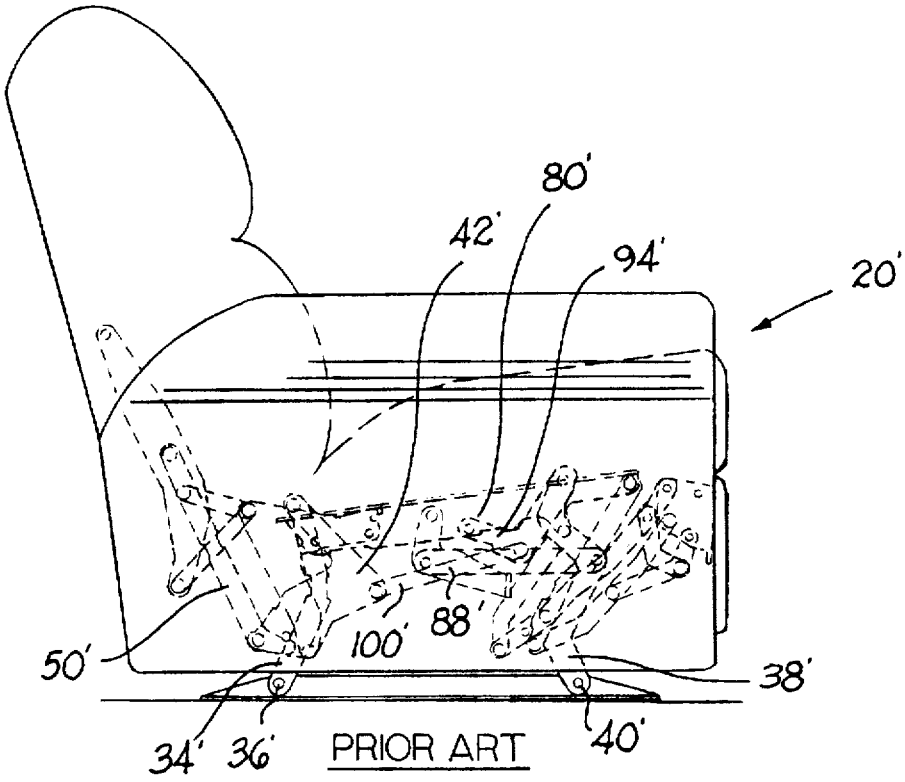
FIG. 4 is a side view of a prior art "zero wall proximity" reclining chair in its upright position.
Figure 5:
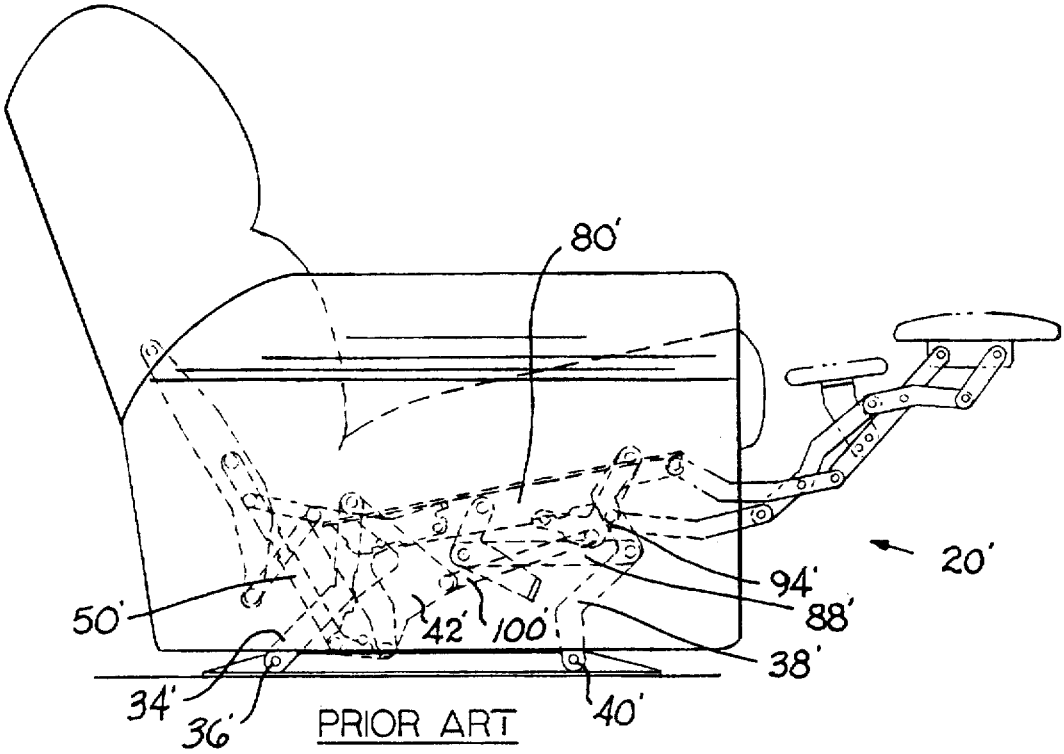
FIG. 5 is a side view of the chair of FIG. 4, with the chair in its TV position.
Figure 6:
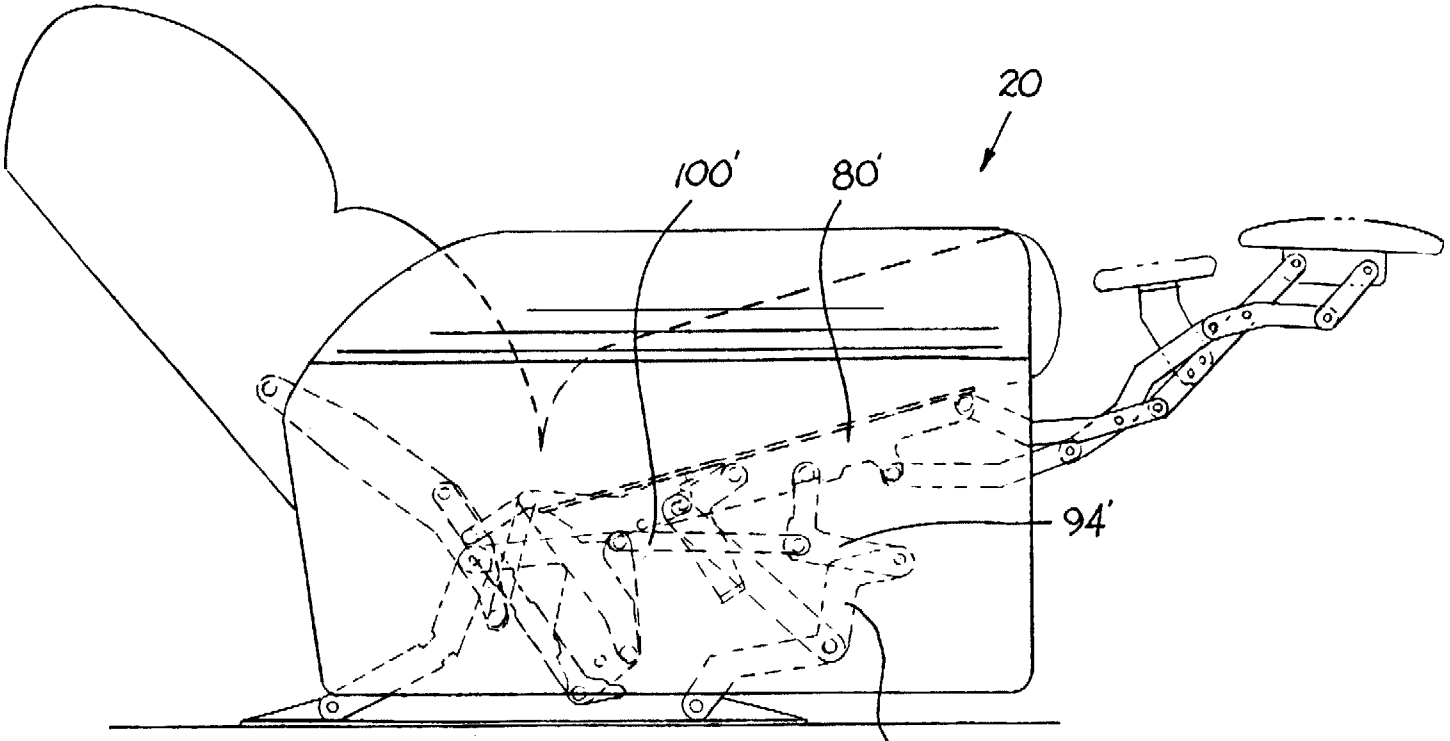
PRIOR ART FIG. 6
FIG. 6 is a side view of the chair of FIG. 4, with the chair in its fully reclined position.

Comparing the reclining portion 21 of the sofa 20 to the prior art chair 20' shown in FIGS. 4 through 6, the similarities of certain of the links comprising the reclining mechanisms of each chair can be observed; however, when the chair 20 of the present invention is in its upright position, the links of the mechanism 30 that are also present in the prior art chair 20' are positioned as they would be when the prior art chair 20' is in its TV position (FIG. 5) rather than in its upright position (FIG. 4). The rear and front swing links 34, 38 of the chair 20 are positioned substantially as are the rear and front swing links 34', 38' of the chair 20'. The same is true for the transitional panel 42 and the corresponding transition panel 42', the connecting link 100 and the corresponding connecting link 100', the elevating link 94 and the corresponding elevating link 94', and the seat rail 80 and the corresponding seat rail 80'.

Notably, the rear and front swing links 34, 38 are mounted on the base rail 32 so that the pivot 36 between the rear swing link 34 and the base rail 32 is slightly elevated relative to the pivot 40 between the front swing link 38 and the base rail 32; the locations of these pivots differ from that of the prior art chair 20', in which the pivots 36', 40' are at substantially the same elevation. This elevational difference causes the seat rail 80 of the reclining portion 21 (and thus the seat 28) have a slightly shallower pitch angle when it is in the upright position than the seat of the prior art chair 20' has in the TV position; instead, the pitch angle of the seat 26 mirrors that of the prior art chair 20' when the prior art chair 20' is in its upright position (FIG. 4). As a result, the reclining portion 21 provides a similarly comfortable sitting surface as that of the prior art chair 20' even though the links of its mechanism 30 are positioned in what would be the reclined TV position in the prior art chair 20'. It is also notable that the pivots 36, 40 between the base rail 32 and the rear and front swing links 34, 38, respectively, are positioned rearwardly on the base rail 32 compared to their corresponding positions on the prior art chair 20'.

To move the reclining portion 21 from the upright to the reclined position of FIGS. 3 and 8, an occupant applies a rearwardly directed force to the backrest 26. This is usually done by the occupant with his back while seated. This force is transferred through the backrest 26 to the backrest post 56, causing it to pivot relative to the seat rail 80 about the pivot 70. This movement drives the seat rail 80 forwardly and pivots it so that its forward end rises. The pivotal movement of the backrest post 56 also causes the pivot 64, and thus the upper end cf the driving link 50, to move forwardly and slightly downwardly relative to the base 22. As the lower end of the driving link 50 moves forwardly, it drives the pivot 52 forwardly. The forward movement of the pivot 52 and the pivotal movement of the rear drawing link 66 (caused by pivoting of the seatrail 80) combine to rotate the transition panel 42 so that the extension leg 44 is lowered. The lowering of the extension leg 44 causes the rear swing link 34 to pivot about the pivot 36 so that its upper end moves downwardly and forwardly. As the transition panel 42 rotates about the pivot 68, it draws the connecting link 100 rearwardly, and also draws the rearmost end of the connecting link 100 upwardly.

The respective movements of the connecting link 100 and the seat rail 80 cause the elevating link 94 to rotate relative to the seat rail 80 about the pivot 98 so that its forward end drops. The lowering of the forward end of the elevating link 94 drives the upper end of the front pivot link 38 downwardly and forwardly. This movement of the front pivot link 38 causes the pivot 90, and the front drawing link 88 connected thereto, to move downwardly and forwardly also. The reclining movement of the mechanism 30 ceases when the stop pin 55, located on the main branch 51 of the driving link 50, contacts the notch 49 of the transition panel 42.

In the reclined position, the seat 28 is inclined at a pitch angle relative to the underlying surface that is steeper (typically between about 0 and 5 degrees) than that observed in the upright position. The seat 28 moves forwardly about 6 inches; preferably, the mechanism 30 is configured so that the seat 28 moves forwardly between about 3 and 10 inches, and more preferably moves forwardly between about 3 and 8 inches. The backrest 26 is positioned so that it is less upright than in the upright position, with its upper end portion being lower than in the upright position and its lower end portion being positioned forwardly of its position in the upright position. The angular change of the backrest 26 relative to the base 12 is between about 25 and 40 degrees. The backrest upper end portion is positioned between 0 and 6 inches rearwardly from its position in the upright position.

In its reclined position, the reclining portion 21 of the present invention can be used in conjunction with a coffee table or other occasional table. Because the reclining portion 21 has no extendable footrest, the sofa 20 can be positioned adjacent such a table and reclined without interference from the table. As the reclining portion 21 reclines such that the backrest 26 moves only slightly rearwardly (between about 0 and 6 inches), the sofa 20 can be positioned with the backrest 26 adjacent a wall. This wall-proximity capability is particularly useful for multi-seat seating units such as sofas and love seats, which are the type of seating units that generally are placed adjacent a coffee table and are often placed against a wall. In addition, if the occupant desires support for his feet, an ottoman or other foot support can be provided.

Comparing the reclining portion 21 in the reclined position of FIGS. 3 and 8 to the prior art chair 20' in its fully reclined position, the rear and front swing links 34, 38 have each pivoted about their respective pivots 36, 40 with the base 32 so that their forward ends have moved forwardly and downwardly to positions that mirror those of the rear and front swing links 34', 38' of the chair 20' when it is in the fully reclined position. The driving links 50 and 50'; the transition panels 42, 42', the connecting links 100, 100, the elevating links 94, 94', and the front drawing links 88, 88' are positioned similarly in both the reclining portion 21 of the present invention and the prior art chair 20'. The seat rail 80 is inclined at a slightly shallower pitch angle than that of the prior art chair 80'.

Comparison of the reclining portion 21 of the present invention and the prior art chair 20' demonstrates how a reclining press-back seating unit can be designed and constructed using a known mechanism for a three-way reclining seating unit that includes a footrest linkage. Once such a three-way mechanism is identified, it is then redesigned so that the footrest linkage is absent and so that it can be mounted to the base with its links in substantially the same relative positions as their corresponding links in the three-way mechanism would be in the TV position, such that the seat is disposed at a pitch angle that is comfortable to a seated occupant. This is preferably done by (a) mounting the swing links or other members that attach the mechanism to the base so that the pivots between the rearmost of these links are elevated relative to the base compared to the original three-way mechanism, and (b) positioning these pivots rearwardly on the base relative to their positions in the prior art mechanism. Positioning the pivots to adapt the pitch angle of the seat enables the mechanism to be used in a unit like the sofa 20 that has other seating surfaces with the seating surface of the reclining portion 21 should be aligned. Positioning the pivots rearwardly positions the seat properly above the base. Once these designing steps are carried out, the press-back seating unit can then be constructed with the mechanism.

Following this method enables the designer to provide a press-back version of a known mechanism rapidly rather than being forced to design a new press-back mechanism from scratch. Also, because many of the links used in the mechanism can be the same as those used in the three-way version, the mechanism and seating unit can be produced in large part with the same equipment used to form the links of the three-way unit, thereby reducing the cost for producing both units.

Figure 9:
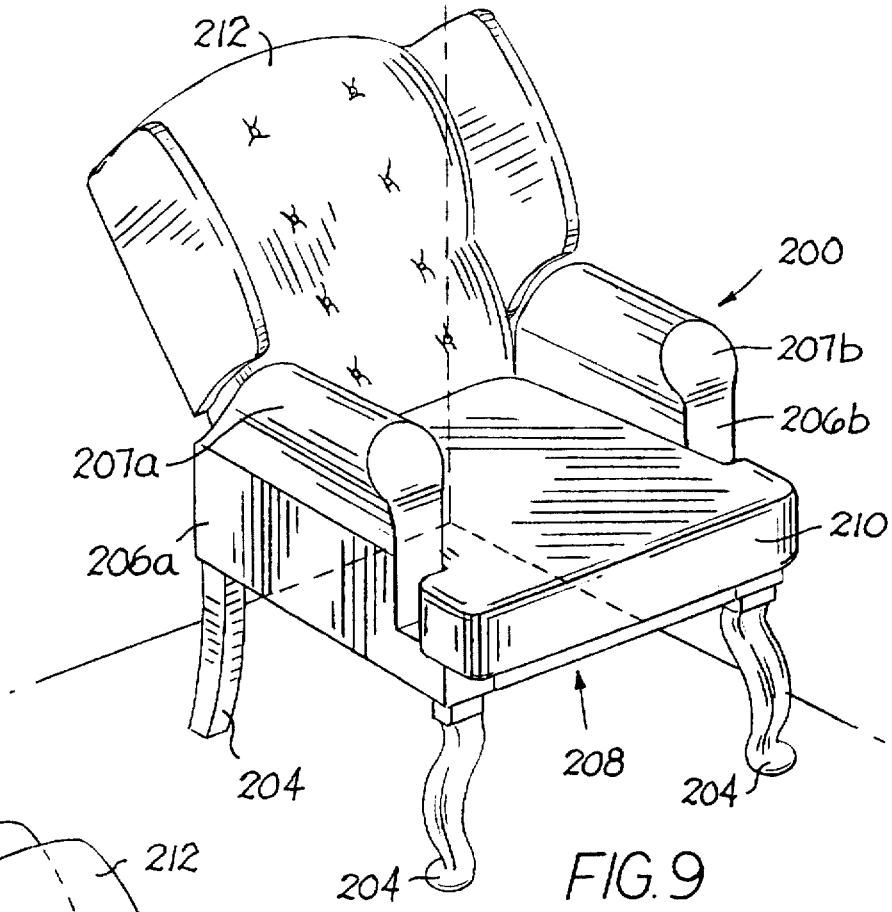
FIG. 9 is a perspective view of a high-leg press-back recliner chair.
Figure 10:
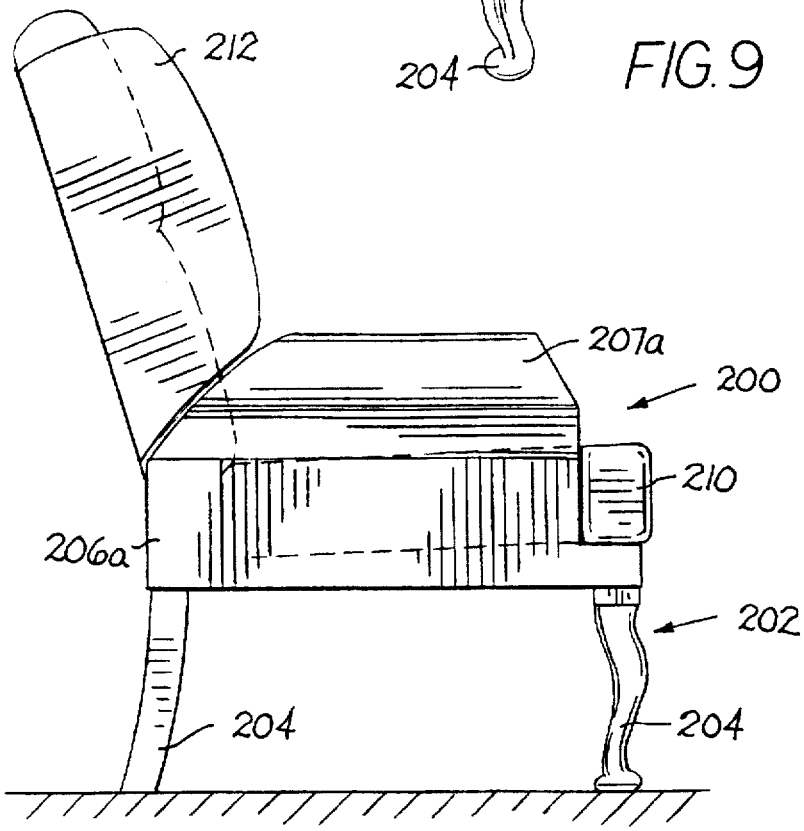
FIG. 10 is a side view of the chair of FIG. 9 in its upright position.
Figure 11:
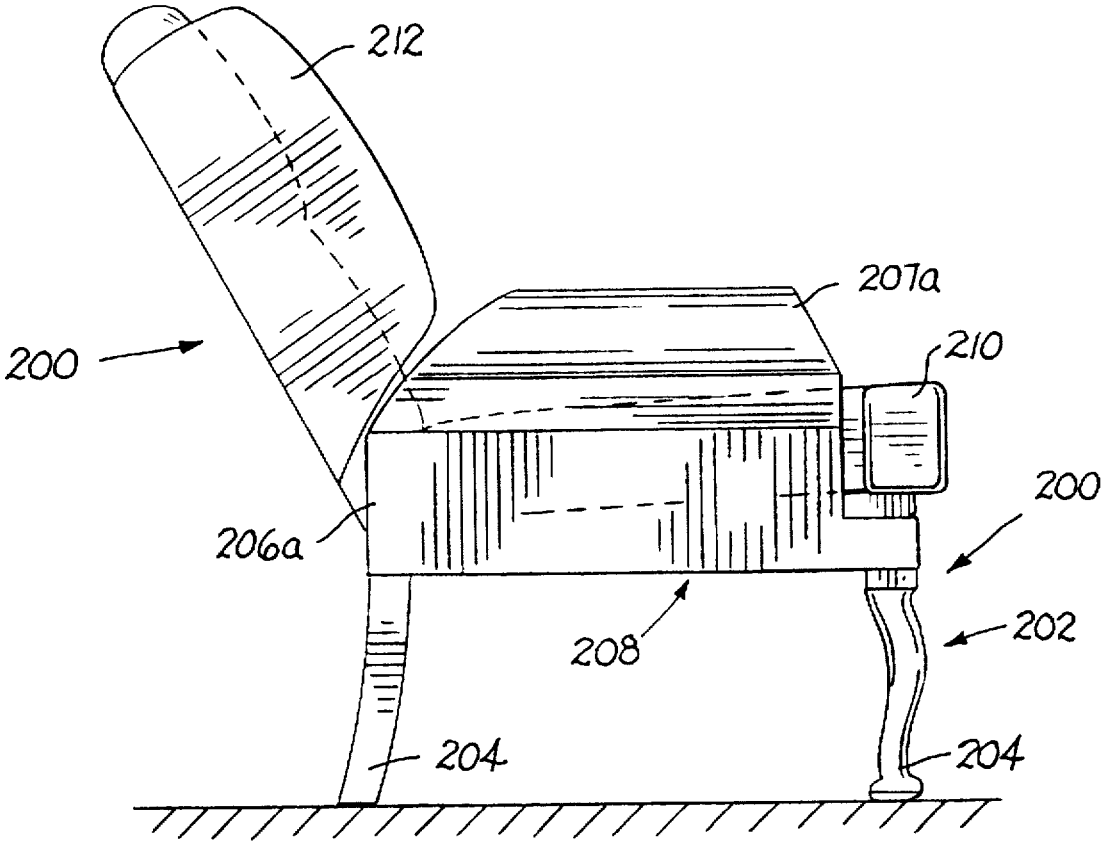
FIG. 11 is a side view of the chair of FIG. 9 in its reclined position.
Figure 12:
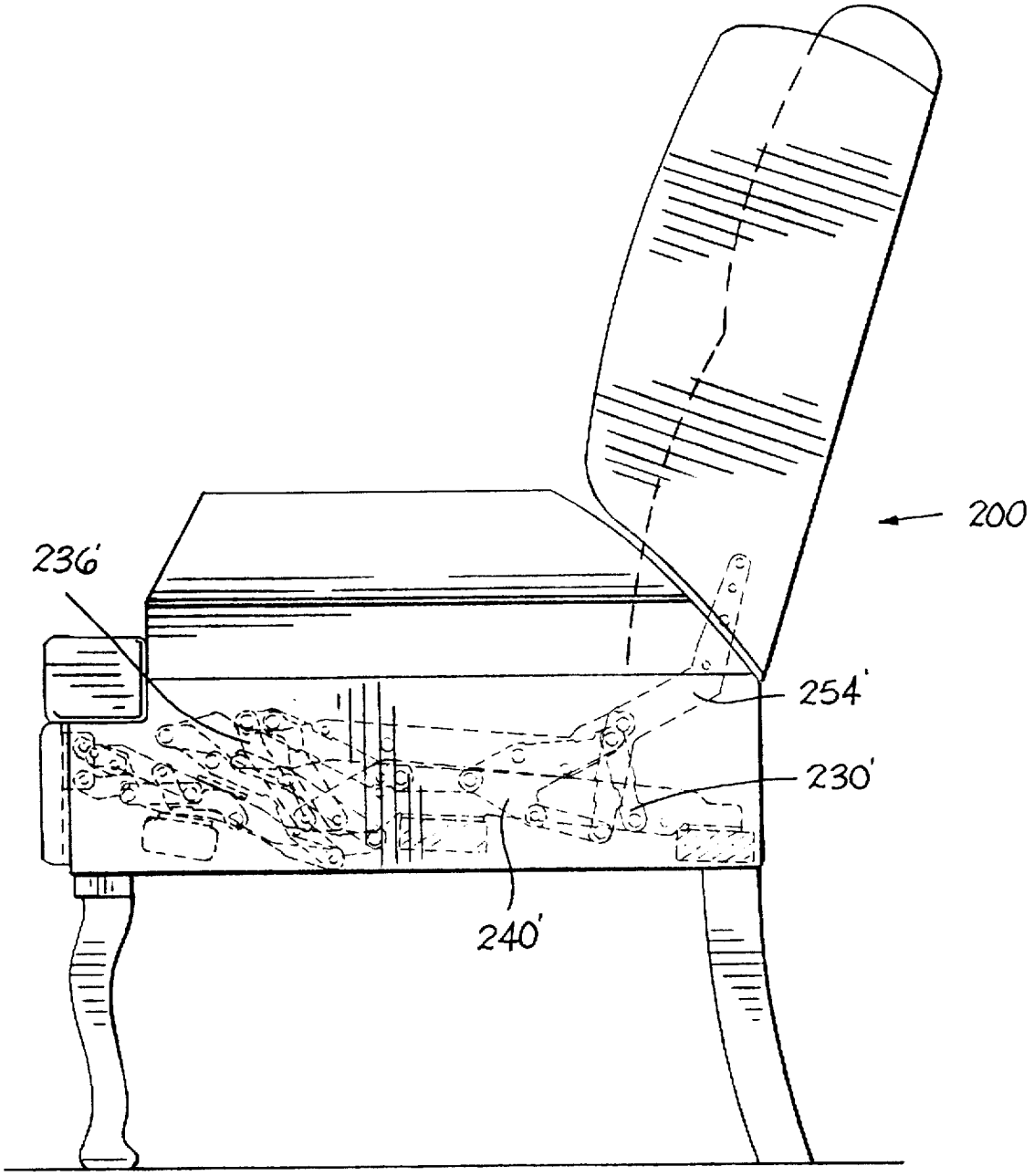
PRIOR ART FIG. 12
FIG. 12 is a side view of a prior art high-leg recliner chair in its upright position.

The method of the present invention is also demonstrated in FIGS. 9 through 11, which illustrate a high-leg press-back reclining chair, designated broadly at 200. The chair 200 includes a base 202 having four legs 204 and a generally horizontal fabric seat deck 208. A pair of side panels **206*a*, 206*b* are attached to the lateral edges of the seat panel 208 and terminate at their upper ends as armrests 207*a*, 207*b*. The legs 204 support the seat deck 208 so that a substantial gap (preferably between about 6 and 9 inches in the front and between about 5 and 8 inches in the rear) is formed between the lowest portion of the side panels 206*a*, 206*b* and the underlying surface. The chair 200 also includes a backrest 212 that is attached generally above the rear portion of the base 202. A seat cushion 210 rests atop the seat deck 208**.

Although the chair 220 is illustrated and described herein, those skilled in this art will appreciate that the present invention is suitable for use with a variety of seating units, such as love seats, sofas, couches, pit-style sofas, and motion modular units, which can be designed and constructed as high-leg seating units.

Figure 15:
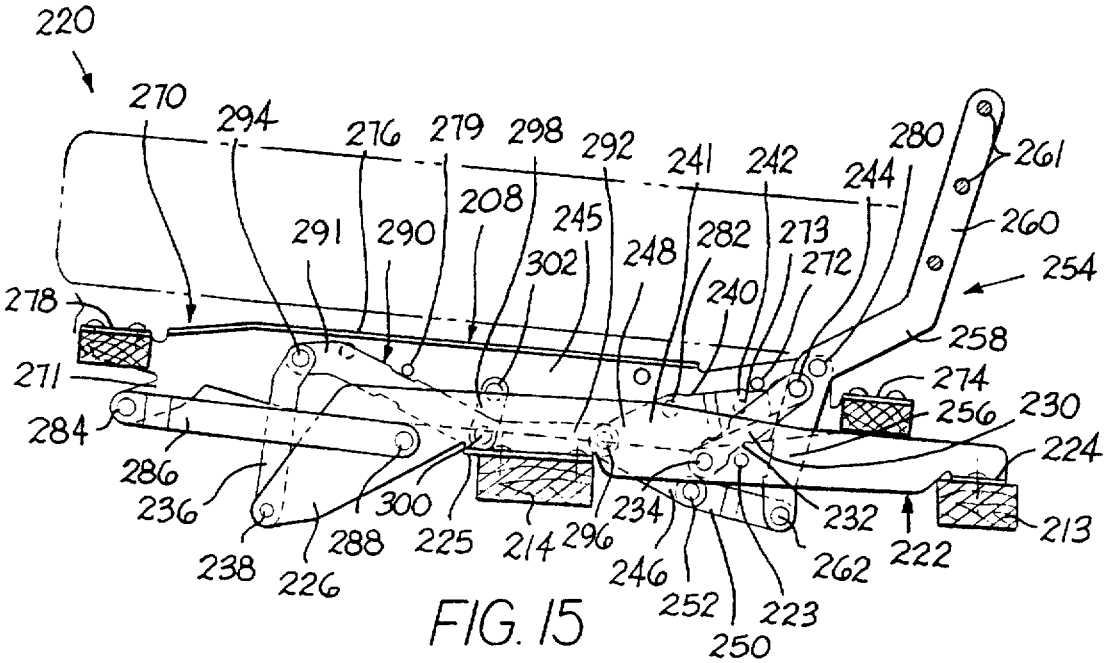
FIG. 15 is a side view of the mechanism for the chair shown in FIGS. 9 through 11, with the mechanism in its upright position.
Figure 16:
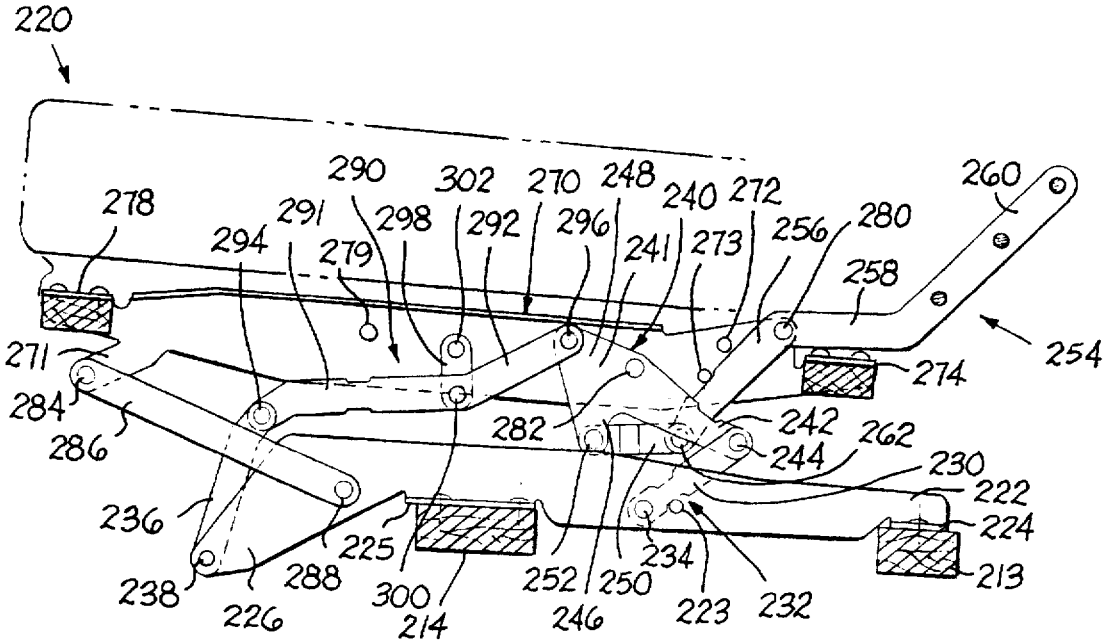
FIG. 16 is a side view of the mechanism of FIG. 15 in its reclined position.

The chair 200 is movable between an upright position shown in FIGS. 10 and 15 and a reclined position shown in FIGS. 11 and 16. In the upright position, the seat deck 208 slopes slightly downwardly from its forward end portion to its rearward end portion, and the backrest 212 is generally upright, with its upper end portion positioned slightly rearwardly of its lower end portion. In the reclined position, the seat deck 208 has moved forwardly and is inclined at a steeper pitch angle than in the upright position, and the backrest 212 is pivoted relative to the seat deck 208 to be less upright than in the upright position, with its upper end portion being positioned lower than in the upright position.

The movement of the chair 200 between the upright and reclined positions is controlled by a pair of mechanisms 220, one of which is illustrated in FIGS. 15 and 16. Each mechanism 220 comprises a series of pivotally interconnected links. Those skilled in this art will understand that the mechanisms 220 are mirror images of one another about a plane bisecting the chair 200 equidistant between the armrests **207*a*, 207*b*. In the interest of brevity and clarity, only one mechanism 220 will be described in detail herein; those skilled in the art will recognize that this description is equally applicable to the other mechanism 220**.

The links of the mechanism 220 are attached to the chair base 202 through a base bracket 222 and to the seat deck 208 through a seat bracket 270. The base bracket 222 includes a horizontally extending rear flange 224 and a horizontally extending front flange 225, each of which are bolted to respective cross-braces 213, 214 of the base 202. A forward extension wedge 226 extends forwardly of and downwardly from the front flange 225. Also, a stop pin 223 extends laterally from the base bracket 222 between -he front and rear flanges 224, 225.

The seat bracket 270 comprises a generally planar and generally vertically disposed main portion 275 having rear, central, and front flanges 274, 276, 278 extending inwardly therefrom. The rear and front flanges 274, 278 rest atop cross-braces **277*a*, 277*b*. The central flange is attached to the seat deck 208. A front finger 271 extends forwardly and downwardly from the front portion end of the main portion 275. A stop pin 279 is positioned centrally in the main portion 275, and stop pins 272 and 273 are positioned on the main portion 275 between the rear and central flanges 274, 276**.

The base bracket 222 is attached to a pair of swing links 230, 236. The rear swing link 230, which is pivotally attached at one end to the base bracket 220 at a pivot 234, extends upwardly and generally rearwardly therefrom. The rear swing link 230 includes a notch 232 in its rear surface which is positioned to mate with the stop pin 223 when the chair 220 is in its reclined position. The front swing link 236 is pivotally connected to the base bracket wedge 226 at a pivot 238. The front swing link 236 extends generally upwardly and slightly rearwardly from pivot 238.

At its end opposite the pivot 234, the rear swing link 230 is pivotally connected at a pivot 244 to a rotary plate 240. The rotary plate 240 includes a main body 241, a finger 242, a tab 246, each of which extend outwardly from the main body 241, and a wedge portion 248, which projects generally forwardly from the main body 241. The pivot 244 is positioned at the free end of the finger 242. The tab 246 is pivotally interconnected at a pivot 252 to one end of a short transition link 250.

A backrest post 254 attaches to the backrest 212 and interconnects it with the seat deck 208. The backrest post 254, which has a tripartite shape, comprises a lower portion 256, a central portion 258, and an upper portion 260. The lower end of the lower portion 256 is pivotally interconnected to the rearward end of the transition link 250 at a pivot 262. The upper portion 260 of the backrest post 254 is fixed to the backrest 212 via bolts or other threaded fasteners inserted through apertures 261. The backrest post 254 is also pivotally interconnected to the rear portion of the seat bracket 270 via a pivot 280, which is positioned at the vertex of the lower and central portions 256, 258 of the backrest post 254.

A connecting link 286 is pivotally attached to a rearward portion of the forward extension wedge 226 of the base bracket 222 at a pivot 288. The connecting link 286 extends generally forwardly and upwardly therefrom and is connected to the front finger 271 at a pivot 284.

The front swing link 236 is connected at a pivot 294 to an elevating link 290. The elevating link 290 extends generally rearwardly and pivotally interconnects at its opposite end to the wedge portion 248 of the rotary plate 240 at a pivot 296. The central portion of the elevating link 290 is pivotally interconnected at a pivot 300 to a short, generally vertically extending control link 298. The control link 298 is pivotally interconnected at its opposite end to the main portion 275 of the seat bracket 270 rearwardly of the stop pin 279.

In operation, the chair 200 can be moved from the upright position (shown in FIGS. 10 and 15) and a reclined position (shown in FIGS. 11 and 16). In the upright position (FIGS. 9, 10 and 15), the seat backrest 270 (and thus the seat deck 208 and the seat cushion 210) is slightly inclined from its rear end to its front end, thereby forming a pitch angle of between about 0 and 10 degrees, with 5 degrees being preferred, with the underlying surface. The backrest post 254 is generally upright, with its central portion 258 extending upwardly and rearwardly from the lower portion 256 at an angle of approximately 10 degrees. With the backrest post 254 in this position, the backrest 212 is also generally upright, with its upper end portion being positioned slightly rearwardly of its lower end portion. The pivot 262 at the free end of the backrest post lower portion 256 is positioned below the base bracket 222, and the transition link 250 attached thereto extends upwardly and forwardly therefrom. The rotary plate 240 is rotated so that the wedge portion 248 thereof faces forwardly, the finger 242 extends rearwardly and upwardly from the main body 241, and the tab 246 extends rearwardly and downwardly from the main body 241. The rear swing link 230 extends generally rearwardly and upwardly from the pivot 234. At the front end of the mechanism 220, the connecting link 286 extends forwardly and slightly upwardly from the pivot 288. The front swing link 236 extends upwardly and slightly rearwardly from the pivot 238. The elevating link 291 extends generally rearwardly from the pivot 294, with the pivot 294 being positioned above She pivot 300 between the control link 298 and the elevating link 290. The control link 298 is disposed generally vertically and extends upwardly and slightly rearwardly from the pivot 302.

Notably, the mechanism 220 folds into a compact configuration in the upright position, which enables it to be used with a high-leg chair that has a substantial gap between the cross braces 213, 214 and the underlying floor. The mechanism folds into a configuration having a vertical dimension of between about 4 and 6 inches for that portion of the mechanism located between the seat deck 208 and the lowest portion of the mechanism.

Figure 13:
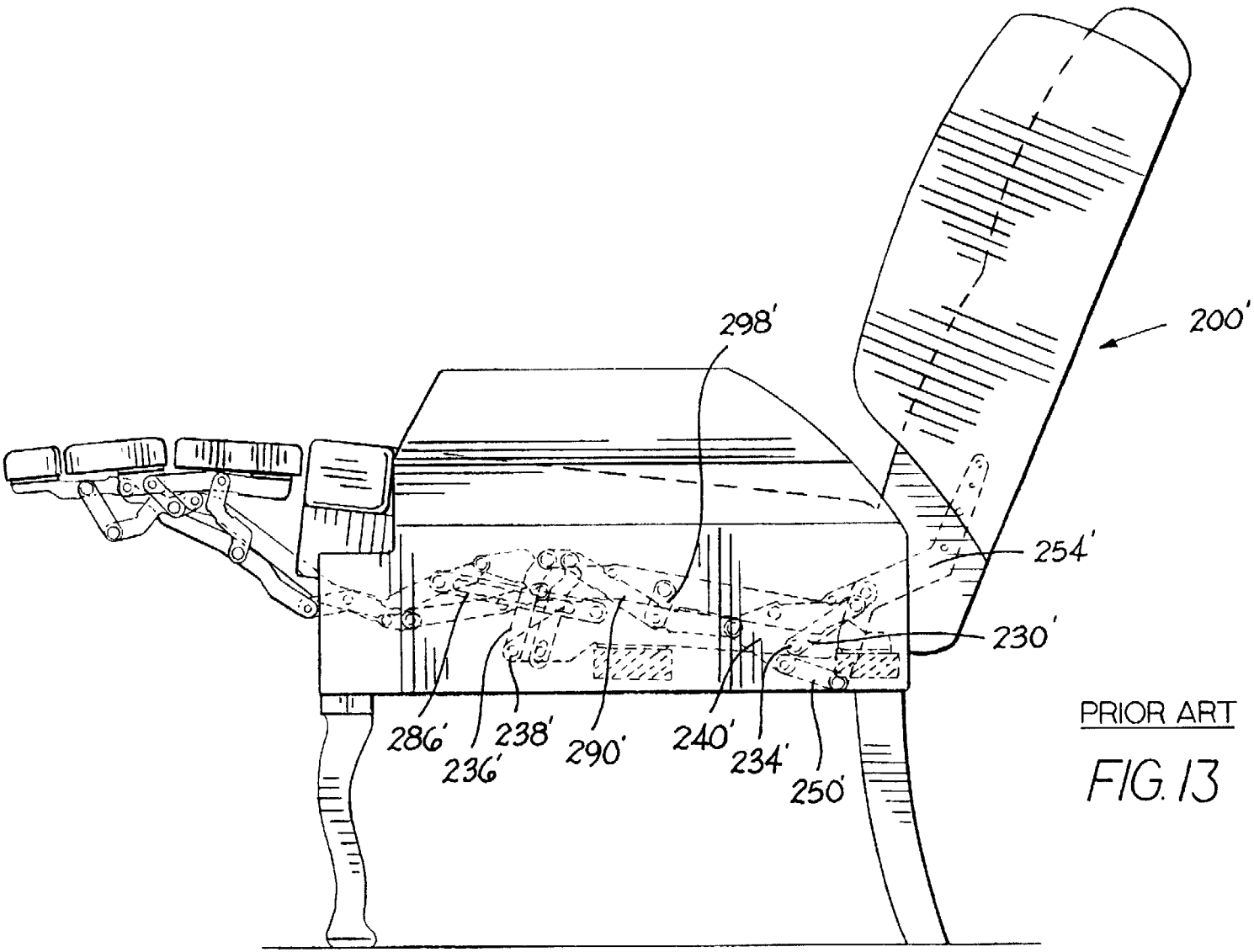
PRIOR ART FIG. 13
FIG. 13 is a side view of the chair of FIG. 12 shown in its TV position.
Figure 14:
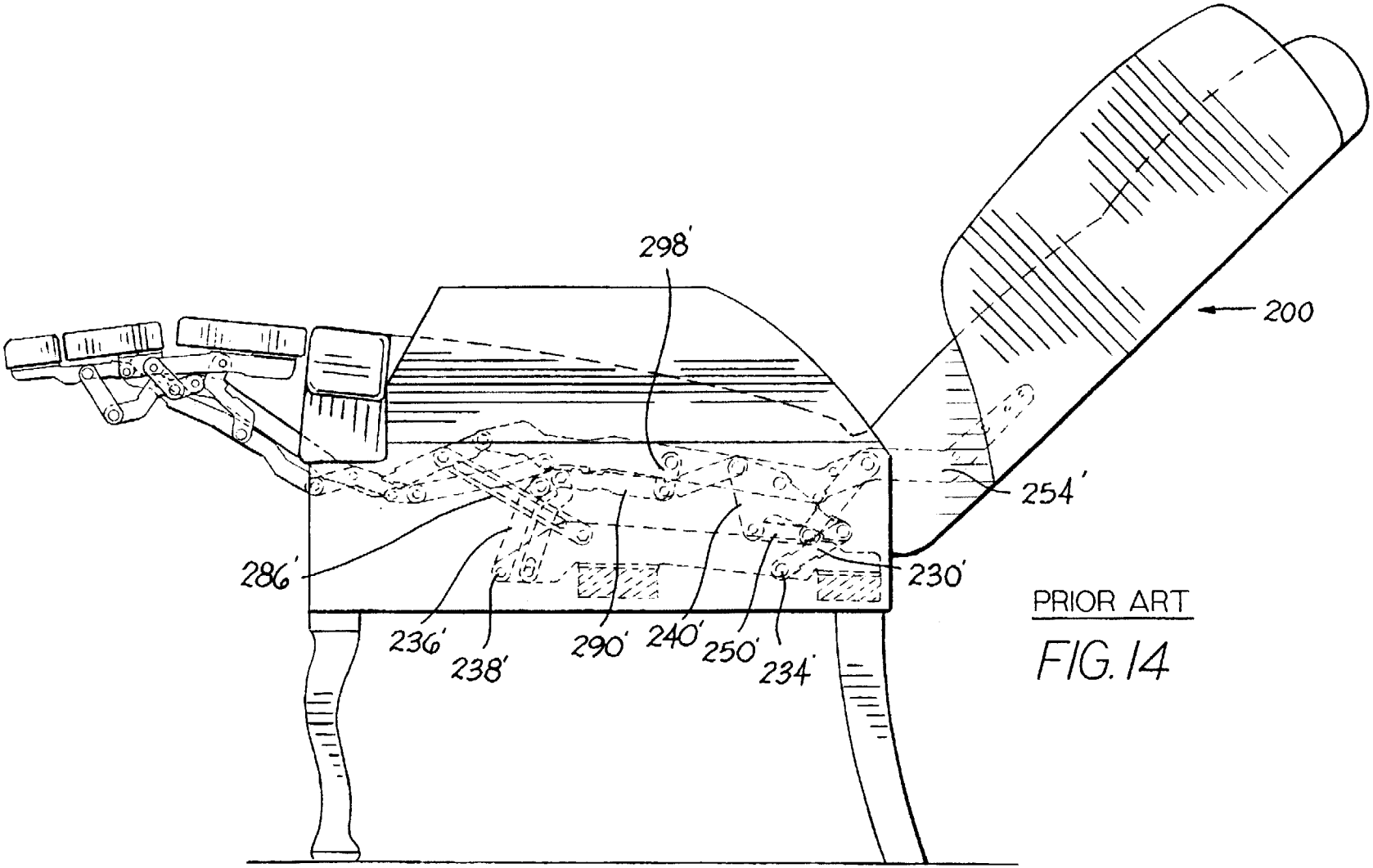
PRIOR ART FIG. 14
FIG. 14 is side view of the chair of FIG. 12 shown in its fully reclined position.

In the upright position shown in FIG. 15, the links comprising the mechanism 220 of the chair 200 closely resemble the positions of the links the mechanism 220' of the prior art chair 200' when the chair 200' is in its TV position. In fact, the relative positions of the corresponding rear swing links 230, 230', front swing links 236, 236', backrest posts 254, 254', transition links 250, 250', rotary plates 240, 240', connecting links 286, 286', elevating links 290, 290', and control links 298, 298' closely resemble one another. However, the rear swing link 230 and the front swing link 236 are mounted on the base bracket 222 so that the difference in elevation between the pivot 234 and the pivot 288 is greater than is the difference in elevation between the pivot 234' and the pivot 238' of the chair 200'. Preferably, this angular difference is between about 5 and 10 degrees, with about 7 degrees being preferred. As a result, when the chair 200 is in the upright position the seat deck 208 has a shallower pitch angle than that of the seat deck of the prior art chair 200' when it is in its TV position. This shallower pitch angle, which more resembles that of the chair 200' in its upright position, provides a comfortable seating surface for an unreclined occupant. In addition, the pivots 234 and 238 are positioned forwardly relative to the base 202 than are the pivots 234' and 238'; this can be best seen by comparing the distance between these pivots to the cross-brace 213 in FIGS. 13 and 15.

To move the chair of the present invention from the upright position (FIGS. 10 and 15) to the reclined position (FIGS. 11 and 16), an occupant of the chair applies a rearwardly directed force to the backrest 212. This force is translated to the backrest post 254, causing it to pivot relative to the seat bracket 270 about the pivot 280. This action causes the lower end of the lower portion 256 of the backrest post 254 to rise and translate forwardly. This movement drives the transition link 250 forwardly, and also induces its rearward end, which is connected to the backrest post 254 at the pivot 262, to rise slightly. The movement of the transition link 250 forces the tab 246 of the rotary plate 240 forwardly, which in turn causes the rotary plate 240 to rotate relative to the seat bracket 270 about the pivot 282. Rotation of the rotary plate 240 drives the finger 242 downwardly, which in turn forces the rear swing link 230 to pivot until the notch 232 contacts the stop pin 223. After this contact, continued rotation of the rotary plate 240 causes the rear end of the seat bracket 270 to rise. In addition, the rotary movement of the rotary plate 240 causes its wedge portion 248 to move upwardly and rearwardly, which elevates the rearward end of the elevating link 290. As the rearward end of the elevating link 290 rises, it draws the lower end of the control link 298 rearwardly and drives the control links 298 upwardly. This action causes the forward end of the seat bracket 270 to rise. The ascension of the elevating link 290 also draws the upper end of the front swing link 236 slightly rearwardly. In addition, the rearward movement of the seat bracket 270 causes the forward end of the connecting link 286 to move slightly upwardly and rearwardly.

By virtue of the movement of the links comprising the mechanism 220, the seat deck 208 and seat cushion 210 are positioned rearwardly and upwardly relative to the base 202 from their positions in the upright position. Preferably, the upward movement of the seat deck 208 is between about 1 and 3 inches, with about 2 inches of upward movement being preferred. Also, it is preferred that the pitch angle of the seat panel deck be essentially the same as that of the upright position. The backrest 212 is less upright than in the upright position; preferably, the backrest 212 pivots relative to the base 202 between about 15 and 35 degrees.

Comparison of the links comprising the mechanism 230 of the chair 200 in the reclined position reveals how they are positioned similarly to the links comprising the mechanism 230' of the prior art chair 200'. The relative positioning of corresponding front swing links 236, 236', rear swing links 230, 230', rotary plates 240, 240', transition links 250, backrest posts 254, 254', connecting links 286, 286', elevating links 290, 290', and control links 298, 298' is quite similar. However, the mounting of the front and rear swing links 230, 236 on the base bracket 222 is such that the pitch of the seat deck 208 is shallower than that of the seat deck 208 of the prior art chair 200' when the prior art chair 200' is in its fully reclined position. Preferably, this pitch angle is between about 5 and 10 degrees relative to the underlying surface.

As was described above for the wall-proximity press-back reclining portion 21 of the sofa 20 illustrated in FIGS. 1 through 3, 7, and 8, the chair 200 can be produced with a number of known three-way mechanisms suitable for use with high-leg seating units. Once the mechanism is identified as a suitable three-way high-leg mechanism, it can be redesigned so that it lacks a footrest and so that it can be mounted within a seating unit with its links positioned in essentially the same positions as the corresponding links of the three-way mechanism would be in the TV position, such that it provides a seat having a pitch angle in the upright position that is comfortable to a seated occupant. As with the reclining portion 21 of FIGS. 1, 2, 7 and 8, this can be accomplished by repositioning the pivots connecting the swing links and the base and by elevating the rear swing link pivot with the base relative to the pivot between the front swing link and the base. The seating unit can then be constructed with the redesigned mechanism.

The seating units of the present invention can include any high-leg seating unit suitable for use with a reclining mechanism. Exemplary suitable seating units include chairs, sofas, couches, love seats, and the like. A preferred seating unit is a high-leg chair that includes a "T-cushion" (i.e., a cushion that includes laterally-extending tabs or ears extending from the lateral portions of its front edge that are positioned directly in front of the armrests) as the seat cushion 210. As the seating unit moves to the reclined position, the seat deck 208 rises, but it moves only slightly rearwardly relative to the base 202 and the armrests 207*a*, 207*b*. As a result, the T-cushion that rests upon the seat deck 208 can essentially remain in place, with its ears positioned in front of the armrests 207*a*, 207*b* and the rear edge of the cushion being positioned in front of and adjacent the lower portion of the backrest 212. In contrast, a reclining mechanism which causes the seat deck 208 to move rearwardly a substantial distance during reclining would either risk damaging the ears of the seat cushion by crushing them against the armrests 207*a*, 207*b* or, more likely, would have a sizable gap between the rear edge of the T-cushion and the lower portion of the backrest 212. This gap would be unsightly and uncomfortable for the occupant.

The foregoing examples are illustrative of the present invention, and are not to be construed as limiting thereof. The invention is defined by the following claims, with equivalents of the claims to be included therein.

That which is claimed is:

1. A seating unit, comprising:

a base configured to rest upon an underlying surface;

a seat positioned generally above said base, said seat having front and rear end portions;

a backrest positioned generally above said base and generally rearward of said seat, said backrest having an upper end and a lower end; and a mechanism interconnecting said base, said seat, and said backrest, said mechanism comprising a plurality of pivotally interconnected links and being free of links forming a footrest linkage, said mechanism being mounted to said base, seat and backrest and configured so that said seat and backrest move between an upright position and a reclined position, wherein in said upright position, said seat slopes slightly downwardly from its forward end portion to its rearward end portion at a first predetermined pitch angle relative to the underlying surface, and said backrest is disposed to be generally upright, with its upper end portion positioned slightly rearwardly of its lower end portion, and in said reclined position, said seat is positioned forwardly of its position in the upright position relative to said base, and said backrest is translated and rotated relative to said seat to be disposed less upright than in the upright position, with its upper end portion being positioned lower than in the upright position and its lower end being positioned forward of its position in the upright position, and said backrest upper end is positioned between about 0 and 6 inches rearward from its position in said upright position, so that said seating unit can be placed in its upright position with said backrest upper end portion between 0 and 6 inches from a wall and can move to its reclined position without said backrest upper end portion striking the adjacent wall;

said backrest upper portion moving downwardly and rearwardly without upward movement as it moves to the reclined position from the upright position.

2. The seating unit defined in claim 1, wherein said mechanism is configured so that said backrest pivots relative to the underlying surface between about 25 and 40 degrees in moving from the upright to the reclined position.

3. The seating unit defined in claim 1, wherein said mechanism is configured so that, in the reclined position, said seat is disposed at a second pitch angle the pitch relative to the underlying surface that exceeds said first pitch angle.

4. The seating unit defined in claim 1, wherein said front end portion of said seat moves forwardly between about 3 and 10 inches in moving from the upright to the reclined position.

5. The seating unit defined in claim 1, further comprising a non-reclining seat section having a stationary seat and a stationary backrest attached to said base, and wherein in the upright position, said seat of said stationary seat section is substantially coplanar with said seat, and wherein said stationary backrest is substantially coplanar with said backrest.

6. The seating unit defined in claim 1, wherein said mechanism is configured such that a rearwardly directed force applied to said backrest by a seated occupant of said seating unit actuates said seating unit to move to the reclined position.

7. The seating unit defined in claim 1, wherein said mechanism includes first and second swing links interconnected to said base at, respectively, first and second pivots.

8. A seating unit, comprising:

a base configured to rest upon an underlying surface;

a seat positioned generally above said base, said seat having front and rear end portions;

a backrest positioned generally above said base and generally rearward of said seat, said backrest having an upper end and a lower end; and a mechanism interconnecting said base, said seat, and said backrest, said mechanism comprising a plurality of pivotally interconnected links and being free of links forming a footrest linkage, said mechanism being mounted to said base, seat and backrest and configured so that said seat and backrest move between an upright position and a reclined position, wherein in said upright position, said seat slopes slightly downwardly from its forward end portion to its rearward end portion at a first predetermined pitch angle relative to the underlying surface, and said backrest is disposed to be generally upright, with its upper end portion positioned slightly rearwardly of its lower end portion, and in said reclined position, said seat is positioned forwardly of its position in the upright position relative to said base, and said backrest is pivoted relative to said seat to be disposed less upright than in the upright position, with its upper end portion being positioned lower than in the upright position and its lower end being positioned forward of its position in the upright position, and said backrest upper end is positioned between about 0 and 6 inches rearward from its position in said upright position, so that said seating unit can be placed in its upright position with said backrest upper end portion between 0 to 6 inches from a wall and can move to its reclined position without said backrest upper end portion striking the adjacent wall;

wherein said mechanism includes first and second swing links interconnected to said base at, respectively, first and second pivots, and wherein said first pivot is positioned rearwardly and upwardly from said second pivot on said base.

9. The seating unit defined in claim 8, wherein said mechanism further comprises a backrest post that interconnects with said backrest, and wherein said first pivot is positioned beneath said backrest post when said seat is in the upright position.

10. The seating unit defined in claim 9, wherein said mechanism further comprises a seat rail that supports said seat, and wherein said backrest post is pivotally interconnected to said seat rail.

11. The seating unit defined in claim 8, wherein said mechanism is configured so that said backrest pivots relative to the underlying surface between about 25 and 40 degrees in moving from the upright to the reclined position.

12. The seating unit defined in claim 8, wherein said mechanism is configured so that, in the reclined position, said seat is disposed at a second pitch angle the pitch relative to the underlying surface that exceeds said first pitch angle.

13. The seating unit defined in claim 8, wherein said front end portion of said seat moves forwardly between about 3 and 10 inches in moving from the upright to the reclined position.

14. The seating unit defined in claim 8, further comprising a non-reclining seat section having a stationary seat and a stationary backrest attached to said base, and wherein in the upright position, said seat of said stationary seat section is substantially coplanar with said seat, and wherein said stationary backrest is substantially coplanar with said backrest.

15. The s eating unit defined in claim 8, wherein said mechanism is configured such that a rearwardly directed force applied to said backrest by a seated occupant of said seating unit actuates said seating unit to move to the reclined position.

16. A seating unit, comprising:

a base configured to rest upon an underlying surface, said base including a pair of armrests;

a seat positioned generally above said base, said seat comprising a seat cushion having a pair of opposed, laterally extending ears, each of which resides adjacent to and forwardly of a respective one of said armrests;

a backrest positioned generally above said base and generally rearward of said seat, said backrest having an upper end portion and a lower end portion; and a mechanism interconnecting said base, said seat, and said backrest, said mechanism comprising a plurality of links and being free of links forming a footrest linkage, said mechanism being mounted to said base and configured so that said seat and backrest move between an upright position and a reclined position, wherein in said upright position, said seat slopes slightly downwardly from its forward end portion to its rearward end portion at a first predetermined pitch angle relative to the underlying surface, and said backrest is disposed to be generally upright, with its upper end portion positioned slightly rearwardly of its lower end portion, and in said reclined position, said seat is positioned rearwardly of its position in the upright position relative to said base, and said backrest is translated and rotated relative to said seat to be disposed less upright than in the upright position, with its upper end portion being positioned lower than in the upright position, wherein in the upright position, the mechanism is configured so that the height between the seat and the lowest point of the mechanism is less than about 6 inches.

17. The seating unit defined in claim 16, wherein said base comprises a plurality of support legs configured to contact the underlying surface so that a substantial gap is present between said mechanism and the underlying surface.

18. The seating unit defined in claim 16, wherein said mechanism is configured so that said backrest rotates relative to the underlying surface between about 15 and 35 degrees in moving from the upright to the reclined position.

19. The seating unit defined in claim 16, wherein said mechanism is configured so that, in the reclined position, said seat is disposed at a second pitch angle the pitch relative to the underlying surface that exceeds said first pitch angle.

20. The seating unit defined in claim 16, wherein said seat includes a front end portion and a rear end portion, and wherein said front end portion of said seat rises between about 1 and 3 inches in moving from the upright to the reclined position.

21. The seating unit defined in claim 16, wherein said mechanism is configured such that a rearwardly directed force applied to said backrest by a seated occupant of said seating unit actuates said seating unit to move to the reclined position.

22. The seating unit defined in claim 16, wherein said mechanism further comprises a rear swing link and a base bracket, said base bracket being fixed to said base, said rear swing link having first and second ends and being pivotally interconnected at said first end with said base bracket at a first pivot, and wherein in said upright position, said rear swing link second end is positioned rearwardly of said first pivot.

23. The seating unit defined in claim 22, wherein said mechanism further comprises a front swing link having first and second ends and being pivotally interconnected at said third end with said base bracket at a second pivot, and wherein in said upright position, said front swing link second end is positioned rearwardly of said rearwardly of said second pivot.

* * * * *